US009657908B2

(12) United States Patent
Millan

(10) Patent No.: US 9,657,908 B2
(45) Date of Patent: May 23, 2017

(54) SYSTEM, COMPONENTS AND METHOD OF A GRADUALLY COLOUR SHIFTED TRAFFIC CONTROL SYSTEM

(71) Applicant: Luis A. Millan, Tucson, AZ (US)

(72) Inventor: Luis A. Millan, Tucson, AZ (US)

( * ) Notice: Subject to any disclaimer, the term of this patent is extended or adjusted under 35 U.S.C. 154(b) by 0 days.

(21) Appl. No.: 14/994,466

(22) Filed: Jan. 13, 2016

(65) Prior Publication Data

US 2016/0225257 A1 Aug. 4, 2016

Related U.S. Application Data

(60) Provisional application No. 62/125,120, filed on Jan. 14, 2015.

(51) Int. Cl.

| | |
|---|---|
| ***G08G 1/095*** | (2006.01) |
| ***F21S 8/08*** | (2006.01) |
| ***G08G 1/096*** | (2006.01) |
| *G08G 1/07* | (2006.01) |
| *G08B 5/36* | (2006.01) |
| *F21S 4/00* | (2016.01) |
| *F21W 111/02* | (2006.01) |
| *F21Y 115/10* | (2016.01) |
| *F21Y 107/60* | (2016.01) |

(52) U.S. Cl.

CPC ..... *F21S 8/08* (2013.01); *G08G 1/096* (2013.01); *F21W 2111/02* (2013.01); *F21Y 2107/60* (2016.08); *F21Y 2115/10* (2016.08)

(58) Field of Classification Search

CPC ..... F21S 8/08; G08G 1/096; F21Y 2115/10; F21W 2111/02

USPC ..... 340/907

See application file for complete search history.

(56) References Cited

U.S. PATENT DOCUMENTS

| | | | | |
|---|---|---|---|---|
| 6,054,932 | A * | 4/2000 | Gartner | G08G 1/095 340/815.45 |
| 2013/0163251 | A1* | 6/2013 | Yang | F41J 5/04 362/249.06 |
| 2015/0042493 | A1* | 2/2015 | McClean | G09F 9/305 340/907 |
| 2016/0311371 | A1* | 10/2016 | Lewerenz | B60Q 9/008 |

* cited by examiner

*Primary Examiner* — Jack K Wang

(74) *Attorney, Agent, or Firm* — Mark Ogram

(57) ABSTRACT

A new and useful system, method and system components are provided, for helping a vehicle operator to ease his/her driving, when is driving at certain speed and is approaching from at a substantial distance to a street intersection so that the decision of whether the vehicle speed should be reduced or maintained can be made at convenient time. By providing with anticipated information relative to an imminent light change, a vehicle operator will have the sufficient time to react calmly to any situation that could put at risk his/her own integrity and/or the integrity of some others. This new and improved traffic control system is designed in a manner that is efficient and effective, in a manner that is useful and helpful, in a manner that is designed in a compact and low profile design; It is designed the best and the most simple way to provide and give to a vehicle operator a better, safely, relaxing and a pleasant driving.

Figure 1:
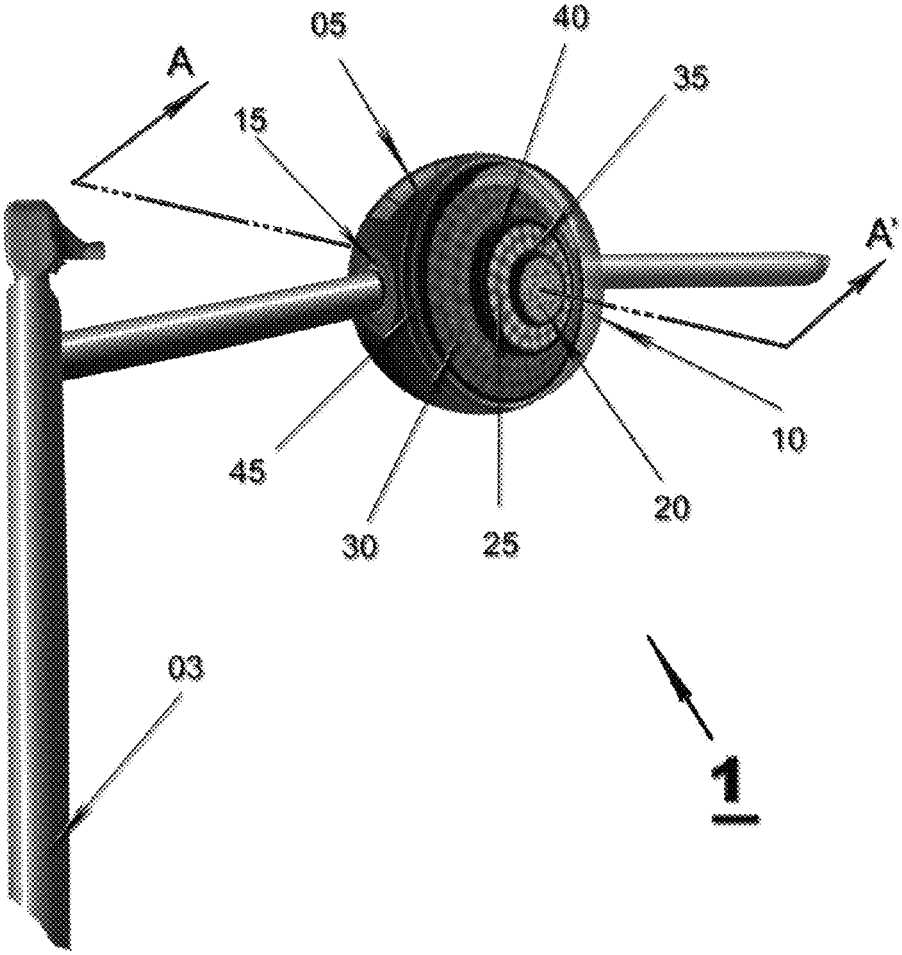

17 Claims, 6 Drawing Sheets fig. 1 Isometric

Figure 2:
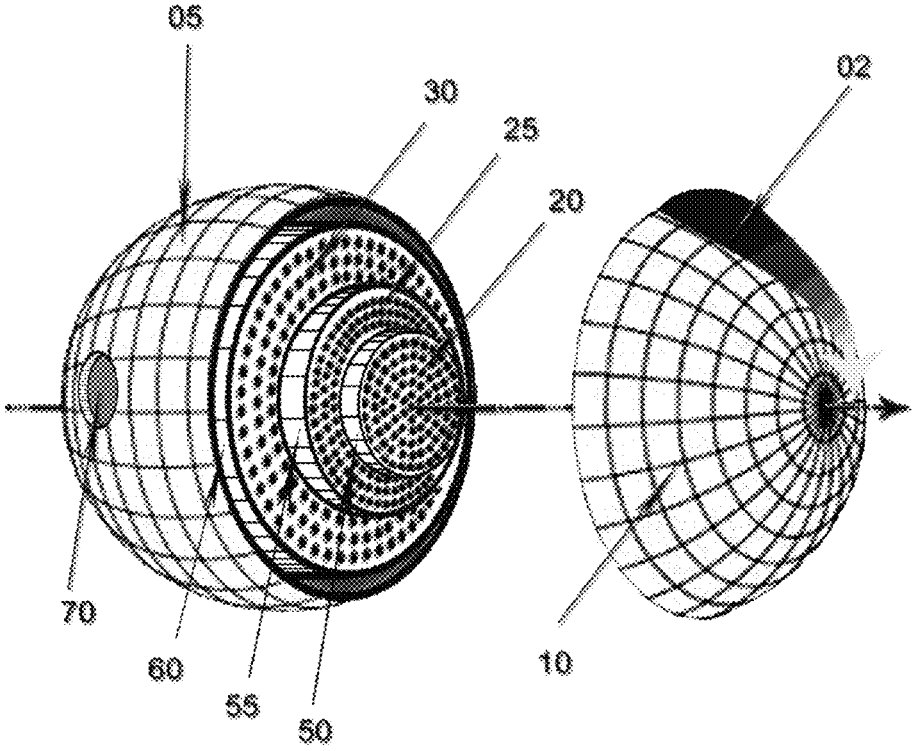

Fig. 2 Perspective view

Figure 3:
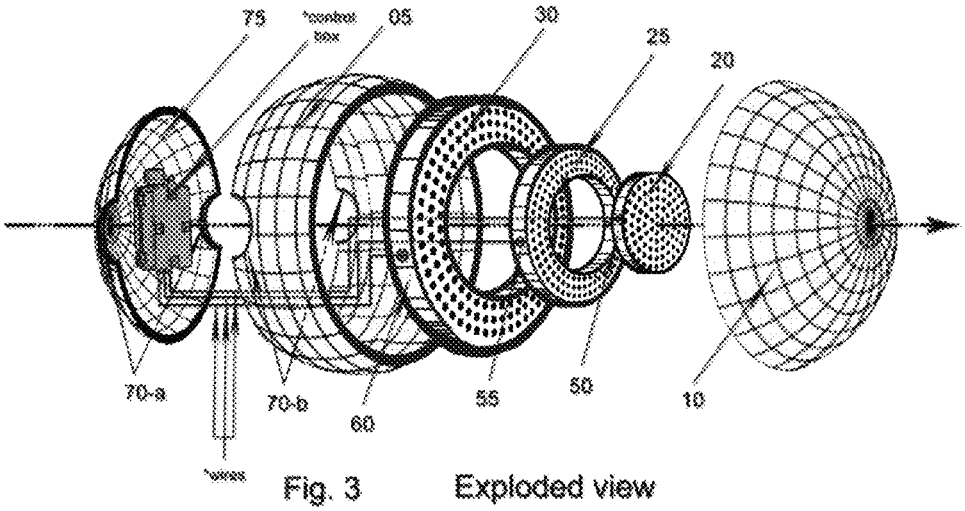

Fig. 3 Exploded view

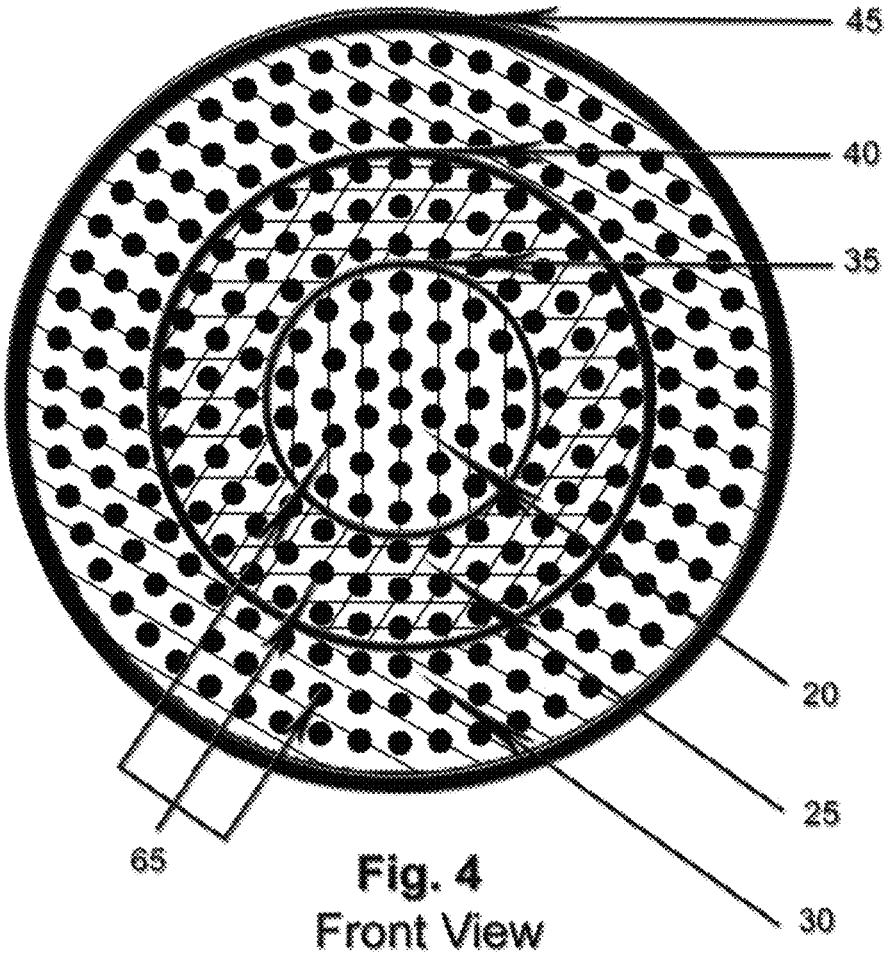
Fig. 4
Front View
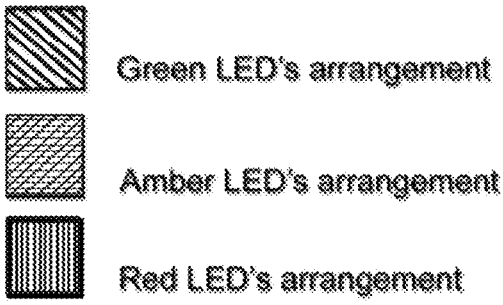

Sliced side View

Fig. 5 (A —— A')

SYSTEM, COMPONENTS AND METHOD OF A GRADUALLY COLOUR SHIFTED TRAFFIC CONTROL SYSTEM

RELATED APPLICATION/CLAIM OF PRIORITY

This application is related to and claims the priority of Provisional Application No. 62/125,120, filed Jan. 14, 2015, and entitled Smartphore gradually color shifted traffic control system, which provisional application is incorporated by reference herein.

INTRODUCTION AND SUMMARY OF THE PRESENT INVENTION

The present invention relates to new and useful traffic control system, which is designed to be particularly effective at providing an oncoming vehicle with a lighting sequence that alerts the vehicle operator to an impending red light signal.

Heretofore the usual method of controlling the flow of passing traffic at given point such a intersection has been to provide a STOP and GO signal at that point. This method is reasonably satisfactory for vehicular traffic that is moving so slowly that the vehicle can come to a practical instantaneous stop. However, for vehicles moving at a higher speed, the reaction time of the vehicle operator plus the deceleration time cause to be some type of warning signal desirable to apprise the operator of an imminent change, such as the amber (yellow) light. The usual amber light used as a warning signal is inadequate for high speed traffic, such as is found on through highways, at the time the amber light is activated, the vehicle, may be running to fast to come to a safe stop prior to the activation of the red light (stop signal); Specially if the vehicle in motion is a heavy big truck travelling at high speed (acceleration), plus the weight (mass) both parts creating a big momentum (Force=mass× acceleration) over the vehicle, with the result, that the operator jams on the brakes causing undue strain on the truck and the possibility of an accident. In the last five or so decades the traffic control system has been changed dramatically with new incursions and adaptations for the vehicular traffic system to find a better solutions to the problem which is caused by the increasing number of vehicles and the increment of the velocity they travel. Recently new traffic signals have been installed to help drivers to make their driving more safe, comfortable and stress less; New signs are being installed, like ones hanging up at front or to the side of the road, even painted inscriptions and lines on the road itself, as well, bigger sign, more explicit, colorful, flashier, and lately electric/electronic lighted signs, causing a rapid transformation over the vehicular landscape. Noticeable transformation to the traffic control system, in which has been paying special attention, are the traffic light signal at the road intersections, new highlighted elements, bright LED's lights, sensor, speed cameras, emergency vehicle alarms, pedestrian crossing auxiliary elements, handicap components, etc. But the semaphore (traffic light) the apparatus itself, has not suffered any relevant changes, it has remained identically as it was originally designed about a century ago, with three basic colors lights in a line formation (Red, Amber and Green) from top to bottom in this specific order; In which at the beginning used to work perfectly due to the slow speed of vehicles, this provides to the driver a much longer time to react to a suddenly event, and came with a solution to avoid any incident that could be occur, but since the speed of vehicles has increased it dramatically compared with the speed of some decades ago, the reaction time has been decreased it as well (The higher the speed, the lower the reaction time); Making those traffic lights apparatus less practical and inadequate day after day, and consequently putting the conductors of the vehicles at the moment of passing these road intersections, in a harsh and stressful position, worries and taking care not to violated any traffic law, due to the traffic light doesn't provide any extra warning signal (besides amber light) to alert an operator about any imminent light color change, that could help the driver, with time in advance, to reduce the speed of his/her vehicle gradually and safe, as well given him/her an extra time to avoid any inconvenient incident.

It is an object of this invention to provide an improved concept for traffic control which avoids the above mentioned objections, and, in particular, which gives an indication or warning of an imminent light change in terms of a vehicle speed.

Another object is to provide a new and useful concept for providing a car operator with anticipated information relative to an imminent light change when he/she is driving at certain speed at a substantial distance from the street intersection so that the decision of whether the vehicle speed should be reduced or maintained can be made at convenient time.

According to the invention a traffic light control system has been designed to provide a warning signal to the operator of a vehicle in a manner designed to shift gradually from green light (go), through the red light (stop) in order to alert to a vehicle operator and to provide him/her with anticipated time to react, so the decision of whether the vehicle speed should be reduced or maintained can be at a convenient time.

According to the present invention a further object is to provide a traffic control system with a new arrangement of lights, this arrangement is divided in sections, each section is composed of concentric circles of lights, with a specific color; all the sections together encompass the three basic colors of a traffic control which are green, amber and red.

Thus, the present invention provides a new and useful concept for a traffic control system. The basic form of the traffic control system comprises a light arrangement of 3 concentric light arrays, an inner array, an outer array and an intermediate array located between the inner and outer arrays. One of the inner and outer arrays (preferably the inner array) comprises a red light array and the other of the inner and outer arrays (preferably the outer array) comprises a green light array. The intermediate array comprises an amber light array. A light control device is provided that illuminates the concentric light arrays in a sequence in which the green light array is illuminated followed by at least a portion of the amber light array and then followed by at least a portion of the red light array, so that a driver approaching the light structure is given an effective visual alert of the impending illumination of the red light array.

According to a preferred embodiment, each of the outer, inner and intermediate arrays comprises concentric arrays of LED lights, each concentric array of LED lights comprising a substrate with the color LED lights of the respective color array of the associated red, green and amber arrays. The substrates carrying the concentric arrays of LED lights are located in a substantially spherical enclosure with a translucent front that enables light produced from the system to be viewed there through. The control device is located in the substantially spherical enclosure and is configured to control the illumination of the concentric arrays of LED lights in a predetermined sequence (e.g. it can illuminate each of the different color arrays individually, or it can illuminate them with some overlap of the color arrays). An annular brim is located at the perimeter of each substrate carrying an array of LED lights.

Other aspects of the invention is that it is designed to integrate some others LED's colors in a specific formation, and with a possible "flashing-strobe" mode, these colors can be blue, red and white, that can be used as an emergency colors to alert an operator vehicle when an emergency vehicle is in the vicinity. Also can accommodate an LED's arrangement of lights with the shape of arrow, for vehicular turning purpose. Some others further objects that can be installed are: a video camera, a laser-radar speed unit, sensor device, etc. That can be inside of the protective spherical shape housing.

Another aspect of the invention is that, it is designed in a single integral unit with a spherical-shape housing to provide a compact, low profile and better aerodynamic shape, and with a touch of a futuristic look.

The subject of this invention relates to an improved method, components and system of a Traffic control (semaphore) system; that preferably provides a series of concentrically arrangement plates, (most preferably round in shape), in which each of these round plates support (or itself provides) a substrate for the LED light arrays of one of the colors, where each substrate has a different number of concentric series of LED's designated with an specific color for each substrate, (which can be green, amber and red); With the green LED's plate as the outer array, the amber LED's plate located at the inner middle position, and red LED's at the centre of the whole arrangement.

Still further, a preferred form of the traffic control system includes one or more (and more preferably all) of the followings parts:

a. A series of LED's lights that can be installed in any place of the system (more preferably inside of the housing) these series of LED's have the shape of an arrows, with the purpose to indicate to a driver, that a turn is allow or do not allow it. Green arrow indicates turn is allow; Amber arrow is precaution at turning and red arrow indicates turn is not allow it.
b. A series of LED's lights that can be installed in any place of the system (more preferably inside of the housing) these series of LED's can be used to alert a driver when an emergency vehicle is in the vicinity, that can be mentioned as emergency lights.
c. Some other elements that can be installed in any place of the system (more preferably inside of the housing) are: a video camera, a laser-radar speed unit, sensor devices, automobiles counter, etc. That can be inside of the protective spherical shape housing.

Other aspect of the present invention will become apparently from the following detailed description and the accompanying drawing and exhibits.

BRIEF DESCRIPTION OF THE DRAWINGS AND EXHIBITS

FIG. 1 is a schematic isometric illustration of the system, including the system components, and some of the elements that make up the traffic control system, according with the principles of the present invention, which include: the housing, front cover shield, the mounting bracket; the green, amber and red LED's arrangement; the brims of green, amber and red LED's arrangements, the cut section A-A', and a pole.

FIG. 2 is a schematic perspective view illustration of the system, including the system components, and the method by which the traffic control system is formed; which include a housing, front cover shield, Green, amber and red LED's arrangements; Plates (substrates) for the green, amber and red LED's arrangements, aperture to install the system, and a gradually Tinted shades graph of the front cover shield.

FIG. 3 is a schematic exploded view illustration of the system including the system components, and the method by which the traffic control system is formed; including a housing, front cover shield, Green, amber and red LED's arrangements; plates (substrates) for each of the green, amber and red LED's arrangements, control device; the two halves that conform the aperture to install the system and a back cover.

FIG. 4 is a schematic front view illustration of the system, including the system components, and the method by which the traffic control system is formed; Which include a green, amber and red LED's arrangements; Brims for green, amber and red LED's arrangements, and some of the LED's singles lights.

Figure 5:
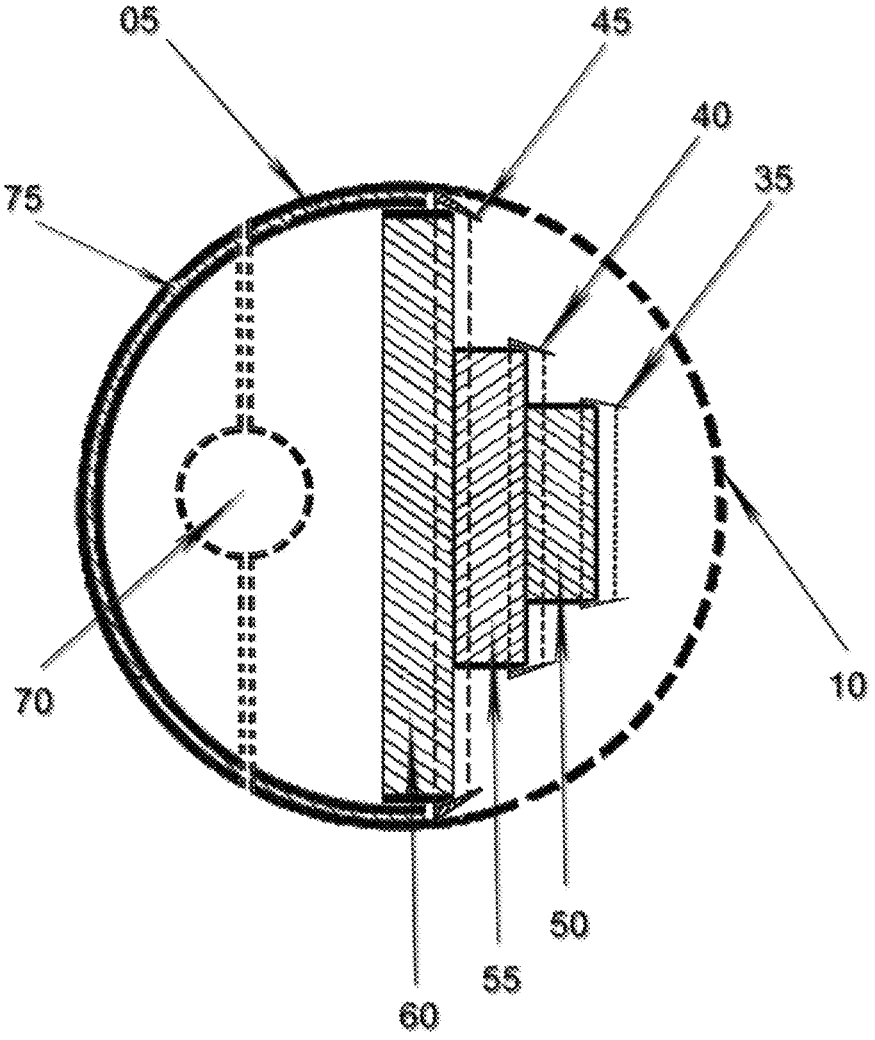

FIG. 5 is a schematic sliced (cross sectional) side view illustration of the system, including the system components, and the method by which the traffic control system is formed; Which include a housing, front cover shield, brims of Green, amber and red LED's arrangements; Plates for green, amber and red LED's arrangements, an aperture to install the system and a back cover.

Figure 6:
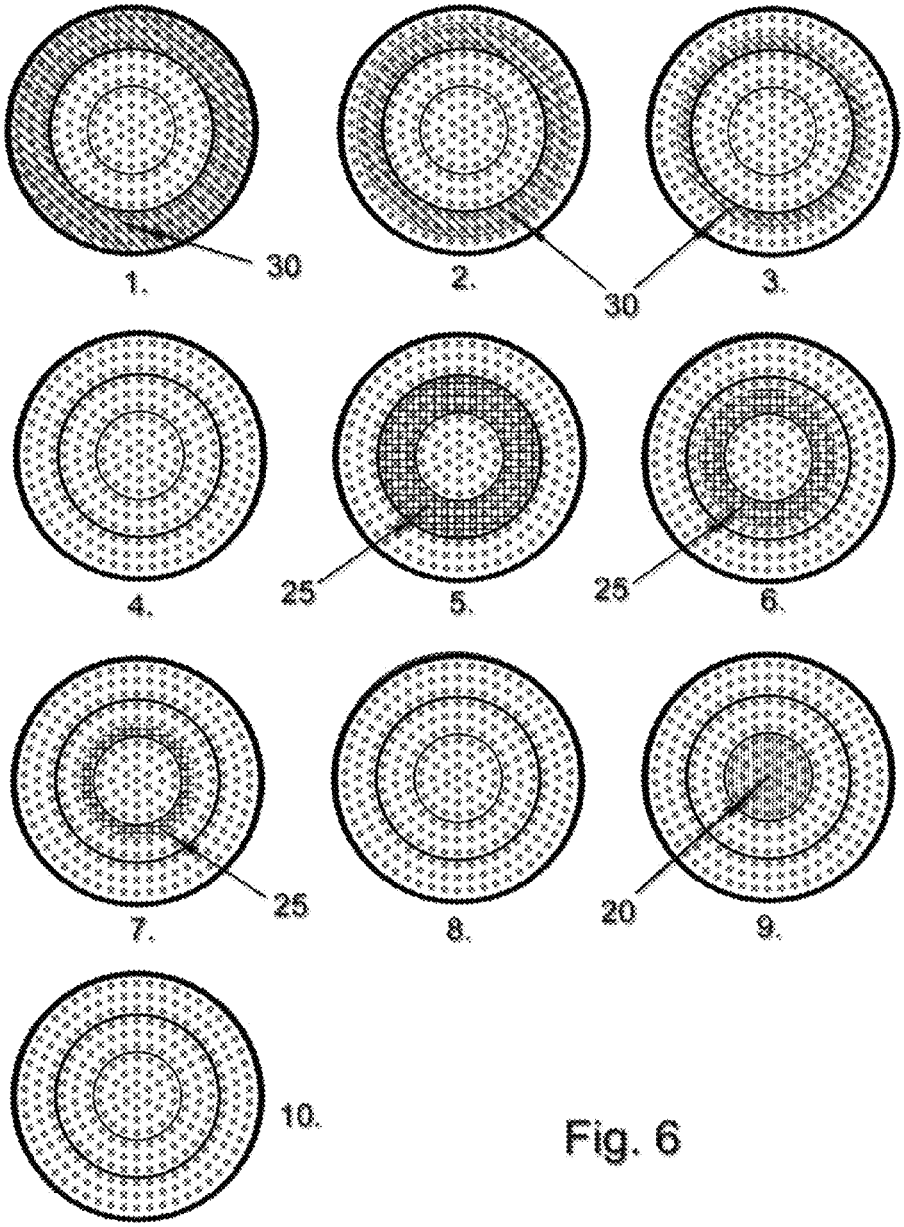

FIG. 6 is a schematic sequence front view illustration of the system, including the system components, and the method by which the traffic control system is formed; Which illustrates the sequences of the Traffic control system and is showing how the different arrangement of LED's lights green, amber and red are gradually shifting.

Exhibit's A, B, C, D, E, F and G are a series of photographs and colored drawings showing the manner in which a traffic control system, according to the invention, is use.

DETAILED DESCRIPTION

As described above, the present invention relates to a new and useful traffic control system; having a new improved arrangement of lights (preferably LED's) that are controlled to perform a gradually shifting color, and designed to provide a warning signal to the operator of an oncoming vehicle by shifting gradually from green light (go), through the red light (stop) in order to alert the vehicle's operator and provide him/her with enough time to react, so the decision of whether the vehicle speed should be reduced or maintained can be at a convenient time. The traffic control system is designed in a manner that is efficient and effective, and provides a compact, aesthetic and a low profile design.

The principles of the invention are described herein in connection with one preferred form of traffic control structure and from that description, the manner in which the principles of the invention can be applied to various forms of traffic control devices will be apparent to these in the art.

As illustrated in the figures, a system according to the invention includes a traffic control system (1) that is primarily formed by, a housing (05) in the shape of a sphere. The housing accommodates inside some other components that are part of the traffic control system, including: the concentric green (30), amber (25) and the red (20) arrays of LED's lights; a plate (60), which forms or carries a substrate for a concentric arrangement of green LED's, plate (55) which forms or carries a concentric arrangement of amber LED's and the plate (50) which forms or carries a substrate for a concentric arrangement of red LED's. As seen from the figures, the plates and their LED's form concentric arrays of green, amber and red lights. The plates (50, 55, 60) keep in place the LED's elements; The front cover shield (10) this translucent component protects the elements inside; the mounting bracket (15); and a series of brims (35,40,45) are associated with the plates and the back cover (75) forms the back of the housing. A control device is located inside the housing and is in circuit communication with the LEDs on each of the plates (see FIG. 3)

As described above, FIG. 1 illustrates some of the components or elements that are part of the traffic control system (1) that is showed in a full display The housing (05) is preferably in the shape of sphere, and is useful in a manner that can be used to hold and protect the rest of the elements that are part of the system. The housing is designed in a compact and low profile design to give it a more aerodynamic design, and has a front cover shield (10) that is useful in a manner that can be used to protect the components inside of the housing (05) from outside environmental hazard elements (e.g. water, dust, moist, etc.). The front cover shield is translucent which allows the LED arrangements (20, 25, 30) to be seen (as well as further elements that are part of the preferred system), in a manner that is visible to any driver approaching the system. Mounting bracket (15) is coupled to the housing (05) is useful in a manner that can be used to support and allow the system to rotate for a better alignment, and can be used to install the traffic control system (1) with a respective supportive pole (03). Some other internal elements are:

a. the concentric multimember array of red color LED's (20) which is useful in a manner that can be used to mark a "Stop" signal, to alert a driver of an imminent stop of the vehicle's transit.
b. the concentric arrangement of multimember array of amber color LED's (25) which is useful in a manner that can be used to mark a "Warning" signal to alert a driver to reduce the speed or to stop the vehicle.
c. the concentric arrangement of multimember array of green color LED's (30) that is useful in a manner that can be used to mark a "Go" signal to alert a driver of a vehicle, that the vehicle is allowed to move forward.
d. A brim (35) that is useful in a manner that can be used to project a shade over the Red LED's (20) arrangement, in a manner to give it more visual effect, thereby to enhance LED's (20) colors.
e. A brim (40) that is useful to project a shade over the Amber LED's (25) arrangement, in a manner to give it more visual effect, thereby to enhance the LED's (25) colors.
f. A brim (45) that is useful in a manner that can be used to project a shade over the Green LED's (30) arrangement, in a manner to give it more visual effect, thereby to enhance LED's (30) colors.

FIG. 2 shows a schematic perspective illustration of the configuration of the traffic control system (1), showing some of the components: specifically, a. the housing (05) preferably in the shape of sphere, which holds and protects the rest of the elements that are part of the system, and is designed in a compact and low profile design to give it a more aerodynamic design,
b. the translucent front cover shield (10) that protects the components inside of the housing (05) from outside environmental elements (e.g. water, dust, moist, etc.), and allows light from the concentric arrays of the LEDs, and other arrangements within the housing (e.g. an arrow graphic (02) that is gradually tinted from darker to lighter shades, to block some sun-rays, in order to enhance the colors of the series of LED's arrangements (20, 25, 30) that are part of the traffic control system (1)
c. the concentric arrangements of multimember Red, amber and green plate (substrate) supported LED's that produce the basic illumination of the traffic control system, and have respective brims that enhance the illumination provided by the LED arrays.
d. the aperture (70) that is useful to secure and lock the mounting bracket (15) element.

□□□□□

FIG. 3 is schematic exploded illustration of the configuration of the traffic control system (1), showing the □□□□□□□□□□□□□□□housing (05), the translucent front cover shield (10), the set of two half-apertures (70-A, 70*b*) that together forms one whole aperture that can be used to support some other element, the concentric arrangements of multimember Red, amber and green plate (substrate) supported LED's that produce the basic illumination of the traffic control system, and have respective brims that enhance the illumination provided by the LED arrays, the back cover (75) and the control device that is in circuit communication with the arrays of green, amber and red LEDs, to control their illumination (e.g. each of the different color arrays can be entirely illuminated sequentially with the other color arrays, or some of the different color arrays can be gradually and sequentially illuminated, or can be illuminated in a fashion that gradually overlaps another color array)

FIG. 4 is schematic front view illustration of the configuration of the traffic control system (1), showing the concentric array of red LEDs (20) located in the centre of the three LED color arrangements, the brim (35) surrounding the red LEDs, the concentric array of amber LEDs surrounding the array of red LEDs, the brim (40) surrounding the array of ambler LEDs, the concentric array of green LEDs surrounding the array of amber LEDs, and the brim (45) surrounding the array of green LEDs;

FIG. 5. (A-A') Is schematic sliced (cross sectional) view illustration of the configuration of the traffic control system (1), showing the housing (05), the translucent front cover shield (10), the aperture (70) that is formed by the elements 70-*a* that is part of the back cover (75) and 70-*b* that is part of the housing (05), and is useful, in securing and locking the mounting bracket, the back cover (75) that is removable to install or to give maintenance to some elements that are inside of the housing (05) and are part of the traffic control system (1) and to protect and to give extra support to the housing (05), the plates with the red, amber and green LEDs, and the brims associated with those plates.

FIG. 6 is a schematic front view sequence illustration of the system, including the system components, and the method by which the traffic control system (1) is formed; which illustrates the sequences of the traffic control system (1) and shows how the different arrangements of green LED's (30) lights, amber LED's (25) lights and red (20) LED's lights are gradually shifting. The following phases explain in detail the performance of the different sections of the traffic control system (1):

Phase 1.—Illustrates the green LED's arrangement (30) in full display, it means, that this section of the traffic control system (1) just starts its sequence, in a manner that, it is sending commands to a vehicle operator (s) to drive forward in a safe disposition.

Phase 2.—Is showing that the first outer circle of the green LED's arrangement (30) is Off, this means, that a vehicle operator can continue to drive forward safely, as well, that he/she has time to proceed and to maintain the speed of the vehicle. This is the first warning for a light color change Phase 3.—showing that the first and second outer circles of green LED's arrangement (30) are Off, this means that a vehicle operator (s) can continue to drive forward safely, as well, that he/she still has time to proceed and to maintain the speed of the vehicle; This criteria will depend on the vehicle speed and the substantial distance to the street intersection, this is a second warning for a light color change.

Phase 4.—Is showing that all the circles of the green LED's arrangement (30) are Off, it means that a vehicle operator may continue to drive with caution, as well if, the decision of whether the vehicle speed should be reduced or maintained can be made at convenient time, depending on the distance in which the vehicle is from the street intersection and provides the last warning to an vehicle operator, about an imminent color light change from the traffic control system (1).

Phase 5.—Illustrates the amber LED's arrangement (25) in full display which is the second section of the traffic control system (1), in a manner that an imminent change of light color had occurred. this means, that a vehicle operator should be prepare to stop he/her vehicle or may continue to drive forward with caution, the decision of whether the vehicle speed should be reduced or maintained can be made at convenient time, depending on the distance in which the vehicle is at this moment from the street intersection.

Phase 6.—Is showing that the first outer circle of the amber LED's arrangement (25) is Off, this mean that a vehicle operator should prepare to stop, due to the information obtained from the traffic control system (1), this represent a warning of an expected change of color light with anticipated time to a vehicle operator.

Phase 7.—Is showing that the first and second outer circles of the amber LED's arrangement (25) are Off, this mean that a vehicle operator should be ready to stop, due to the information obtained from the traffic control system (1), this represent a second warning of an expected change of color light with anticipated time to a vehicle operator.

Phase 8.—Is showing that all the circles of the amber LED's arrangement (25) are Off, this mean that a vehicle operator must be stopped, due to the information obtained from the traffic control system (1), this represent an imminent color light change is about to occur or has occurred.

Phase 9.—Illustrates the red LED's arrangement (20) in full display which is the third section of the traffic control system (1), in a manner that an imminent change of light color had occurred, this means, that all the participating traffic vehicles at this point should be stopped.

Phase 10.—Illustrates the traffic control system (1), and showing that no LED's arrangements (20, 25, 30) are On, this means that the cycle sequence is end it, and the system is about to re initiate its sequence one more time.

The location of the traffic control system, with respect to oncoming vehicles is made with anticipated time at certain distance from the street intersection, that a vehicle operator needs to react to a suddenly event and possibly find a solution to avoid any incident that it could happen, as well, to avoid that a vehicle operator jams on the brakes causing undue strain on the vehicle and with the possibility of an accident when passing through an intersection, and putting he/she in a harsh and stressful position, that he/she might be concerned in violating any traffic law. For this reason the location of each traffic control system can be programmed individually one different from other, with a different intervals of times, this can be applied depending on the configuration and the needs of each street intersection; If the street intersection is too broad, the require programmed interval of times for this particular traffic control system will be longer, in order to give enough time to a driver to cross it and to perform an adequate driving; Compared with one street intersection that is narrow, which will require a shorter programmed interval of times, due to a smaller distance that a vehicle operator has to cross, he/she will require less time to cross it. Therefore, since each street intersection has its own needs, each traffic control system will require its own configuration.

As seen from the foregoing description, applicant has provided a new and useful concept for a traffic control. The basic form of the traffic control structure comprises a light arrangement of 3 concentric light arrays, an inner array, an outer array and an intermediate array located between the inner and outer arrays. One of the inner and outer arrays (preferably the inner array) comprises a red light array and the other of the inner and outer arrays (preferably the outer array) comprises a green light array. The intermediate array comprises an amber light array. A light control device is provided that illuminates the concentric light arrays in a sequence in which the green light array is illuminated followed by at least a portion of the amber light array and then followed by at least a portion of the red light array, so that a driver approaching the light structure is given a visual alert of the impending illumination of the red light array.

Exhibit's A, B, C, D, E, F and G are a series of photographs and colored drawings showing the manner in which a traffic control system, according to the invention, is used.

Thus, applicant has described here a utility Traffic control system and a related assembly method, in which an sphere-shaped housing is installed to a support unit (more preferably a pole), contains and protects in its interior series of components that are essential to the performance of the traffic control system, which includes: A translucent material front cover that protects and lets see through some others components, these are: red LED's arrangement, amber LED's arrangement, green LED's arrangement, those components are coupled respectively with some other components inside of the housing, these are a series of plates; these plates keep in place all the LED's lights elements, also give the shape of a circumference to the different LED's arrangements. Therefore these plates are coupled with one another.

Other components of the system include: A back cover this provides access to the back of the housing to install, to remove or to give maintenance to some components of the traffic control system. Also provides some apertures by the body of the housing (more preferably to the sides) in which a mounting bracket can be installed. Some further components are a series of LED's elements in the form of an arrows, to provide some information about the turning access;

Also includes some other LED's arrangements, in a manner that can be used as an emergency colored lights to alert a vehicle operator when an emergency vehicle is in the vicinity. More further, it can include other components in its system, in which can be: a video camera, a laser-radar speed unit, sensor device, vehicle counter device, etc. That can be installed (more preferably inside of the protective spherical shape housing) and be part of the Traffic control system. In which, has been designed to provide enough anticipated information relative to a imminent light change to a vehicle operator, when he/she is driving at certain speed and is approaching to an street intersection, in order to avoid certain situations that can put at risk his/her integrity. It is designed in the best and simple way to provide to a vehicle operator a better, safety and pleasant driving.

With the foregoing disclosure in mind the manner in which a traffic control system is designed, installed and adapted into other useful devices will be apparent to those in the art.

What is claimed is:

1. A traffic light structure comprising a light arrangement of 3 concentric light arrays, an inner array, an outer array and an intermediate array located between the inner and outer arrays, one of the inner and outer arrays comprising a red light array and the other of the inner and outer arrays comprising a green light array, the intermediate array comprising an amber light array; and a light control device that illuminates the concentric light arrays in a sequence in which the green light array is illuminated followed by at least a portion of the amber light array and then followed by at least a portion of the red light array, whereby a driver approaching the light structure is given a visual alert of the impending illumination of the red light array.

2. The traffic light structure of claim 1, wherein each of the outer, inner and intermediate arrays comprises concentric arrays of LED lights, each concentric array of LED lights comprising the color LED lights of the respective color array of the associated red, green and amber arrays.

3. The traffic light structure of claim 2, wherein each of the outer, inner and intermediate arrays comprises a substrate carrying the concentric arrays of LED lights of the associated red, green and amber arrays.

4. The traffic light structure of claim 3, wherein the substrates carrying the concentric arrays of LED lights are located in a substantially spherical enclosure with a translucent front that enables the light structure to be viewed there through.

5. The traffic light structure of claim 4, wherein the control device is located in the substantially spherical enclosure and is configured to control the illumination of the concentric arrays of LED lights in a predetermined sequence.

6. The traffic light structure of claim 5, wherein the array of LED lights forming the outer array are green LEDs, and the array of LED lights forming the inner array are red LEDs.

7. The traffic light structure of claim 5, wherein an annular brim is located at the perimeter of each substrate carrying an array of LED lights.

8. A traffic light structure comprising:

a) a light arrangement of 3 concentric light arrays having an inner array of red lights, an outer array of green lights, and an intermediate array of amber lights; and, b) a light control device that causes illumination of the concentric light arrays in a sequence in which the outer light array is illuminated followed by at least a portion of the intermediate light array, and then followed by at least a portion of the inner light array.

9. The traffic light structure of claim 8, wherein each of the outer, inner and intermediate arrays comprises at least three concentric circles of lights.

10. The traffic light structure of claim 9, wherein each of the outer, inner and intermediate arrays comprises a substrate carrying concentric arrays of LED lights of the associated red, green and amber arrays.

11. The traffic light structure of claim 9, further including a spherical enclosure with a translucent front that enables the light arrangement to be viewed therethrough.

12. The traffic light structure of claim 11, wherein the light control device is located in the substantially spherical enclosure and is configured to control the illumination of the concentric arrays of LED lights in a predetermined sequence.

13. The traffic light structure of claim 8, further including a first annular brim positioned between the inner and intermediate array of lights, a second annular brim positioned between the intermediate and outer array of lights, and a third annular brim located at an external periphery of the outer array of lights.

14. A light for a traffic signal comprising:

a) a circularly shaped center primary light;

b) a secondary light totally encircling the primary light; and, c) a tertiary light totally encircling the secondary light.

15. The light for a traffic signal according to claim 14, further including a spherical enclosure with a translucent front that enables the primary, secondary, and tertiary lights to be viewed therethrough.

16. The light for a traffic signal according to claim 15, wherein each of the primary, secondary, an tertiary lights include arrays of LED lights.

17. The light for a traffic signal according to claim 16, wherein the arrays of LED lights are chosen from a group consisting of red, green and amber.

* * * * *